US005255643A

United States Patent [19]

Mochizuki et al.

[11] Patent Number: 5,255,643

[45] Date of Patent: Oct. 26, 1993

[54] INJECTION PUMP DRIVE FOR ENGINE

[75] Inventors: Norihisa Mochizuki; Toshio Kinoshita; Takeshi Tanaka, all of Iwata, Japan

[73] Assignee: Yamaha Hatsudoki Kabushiki Kaisha, Iwata, Japan

[21] Appl. No.: 973,191

[22] Filed: Nov. 6, 1992

Related U.S. Application Data

[63] Continuation of Ser. No. 742,402, Aug. 8, 1991, abandoned.

[30] Foreign Application Priority Data

Aug. 8, 1990 [JP] Japan ..... 2-211171

[51] Int. Cl.[5] ..... F02N 17/00; F02M 33/00; F04B 49/00

[52] U.S. Cl. ..... 123/179.17; 123/533; 417/212

[58] Field of Search ..... 123/179 G, 179 L, 198 C, 123/192 R, 497, 499, 509, 495, 179.17; 417/212

[56] References Cited

U.S. PATENT DOCUMENTS

| | | | |
|---|---|---|---|
| 3,363,614 | 1/1968 | Fisher | 123/495 |
| 3,455,105 | 7/1969 | Ito et al. | 417/212 |
| 3,577,965 | 5/1971 | Sundberg | 417/212 |
| 3,690,768 | 9/1972 | Nagasawa | 123/179 L |
| 4,117,821 | 10/1978 | Kawai | 123/179 L |
| 4,295,798 | 10/1981 | McIntosh | 417/212 |
| 4,411,237 | 10/1983 | Ableitner et al. | 123/509 |
| 4,421,076 | 12/1983 | Sasaki | 123/179 L |
| 4,453,522 | 6/1984 | Salzgeber | 123/179 L |
| 4,586,468 | 5/1986 | Dzioba | 123/198 C |
| 4,756,293 | 7/1988 | Suzuki et al. | 123/533 |
| 4,867,115 | 9/1989 | Henein | 123/179 L |
| 4,899,714 | 2/1990 | Schechter et al. | 123/533 |
| 4,936,279 | 6/1990 | Ragg | 123/533 |

FOREIGN PATENT DOCUMENTS

| | | | |
|---|---|---|---|
| 2222435 | 3/1990 | United Kingdom | 123/531 |

*Primary Examiner*—Willis R. Wolfe
*Assistant Examiner*—Thomas Moulis
*Attorney, Agent, or Firm*—Ernest A. Beutler

[57] ABSTRACT

A fuel injection system for an internal combustion engine having a fuel pump drive for driving a fuel pump of the injection system at different speed ratios depending upon the engine conditions. The pump is driven at a higher speed during starting than when the engine is operating.

8 Claims, 4 Drawing Sheets

37
36
38
53
53
98
97
96
39
42
107
75
48
77
43
79
35
81
78
76
86
89
27
94
51
26
84
82
83
88
28
85
91
87
79
95
93
92

INJECTION PUMP DRIVE FOR ENGINE

This is a continuation of U.S. patent application Ser. No. 07/742,402, filed Aug. 8, 1991, now abandoned.

BACKGROUND OF THE INVENTION

The invention relates to an injection pump drive for an engine and more particularly to an improved arrangement for driving the fuel pump of an injection system at varying speeds in response to engine characteristics.

It has been proposed to provide engines with fuel injection systems so as to improve their performance. The use of a fuel injection system is advantageous in that it will insure that the appropriate amount of fuel/air mixture is present in the engine under all running conditions. In addition to applying the use of fuel injection to four cycle engines, fuel injection has been found as a very effective means of controlling the emissions and performance of a two cycle engine.

In conjunction with the use of fuel injection, there is normally provided a high pressure pump for delivering fuel under high pressure to the fuel injector. Normally these pumps are driven from the engine either directly or through some form of gear train. In many engine applications, however, the engine operates at a very wide range of speeds. Therefore, the fuel injection pump itself may be driven at wide speed ranges and with most pumps the output pressure of the pump will vary with the speed at which it is driven. Therefore, it is the normal practice to employ some form of regulating system for regulating the output pressure of the pump so as to maintain a more uniform pressure regardless of the speed variation of the pump. Although the use of regulators is effective, a regulator cannot maintain a full control of the pressure of the fuel pump under all speed conditions since most regulators are effective only to limit the maximum pressure output of the pump. Therefore, it has been the practice to compromise the speed ratio at which the pump is driven and the pressure at which the fuel is regulated so as to achieve optimum performance.

However, the regulation of the pump pressure and the choosing of a single speed ratio for driving the pump is not adequate under all circumstances. For example, during cranking of the engine the engine is normally turned over at a much lower speed than even its normal idle speed. If the pump speed ratio is chosen so that the pump will not output too high a pressure at maximum speed, then the pump output may be somewhat marginal at idle. If this is the case, then during cranking there may be inadequate pump pressure output to supply sufficient fuel to the engine for starting.

It is, therefore, a principal object of this invention to provide an improved fuel pump drive for the injection system of an internal combustion engine.

It is a further object of this invention to provide a fuel pump drive arrangement for a fuel injection system of an engine that operates at varying speed ratios depending upon the engine condition.

It is a further object of this invention to provide a two speed drive for the fuel pump of an engine induction system which will operate the pump at a faster speed ratio during starting than during running.

SUMMARY OF THE INVENTION

This invention relates to a fuel injection system for an internal combustion engine having a fuel injector and a pressure fuel pump driven by the engine for supplying fuel to the fuel injector. In accordance with the invention, a variable speed transmission drives the fuel pump from the engine for varying the speed ratio between the engine output shaft and the fuel pump.

DETAILED DESCRIPTION OF THE PREFERRED EMBODIMENT OF THE INVENTION

Figure 1:
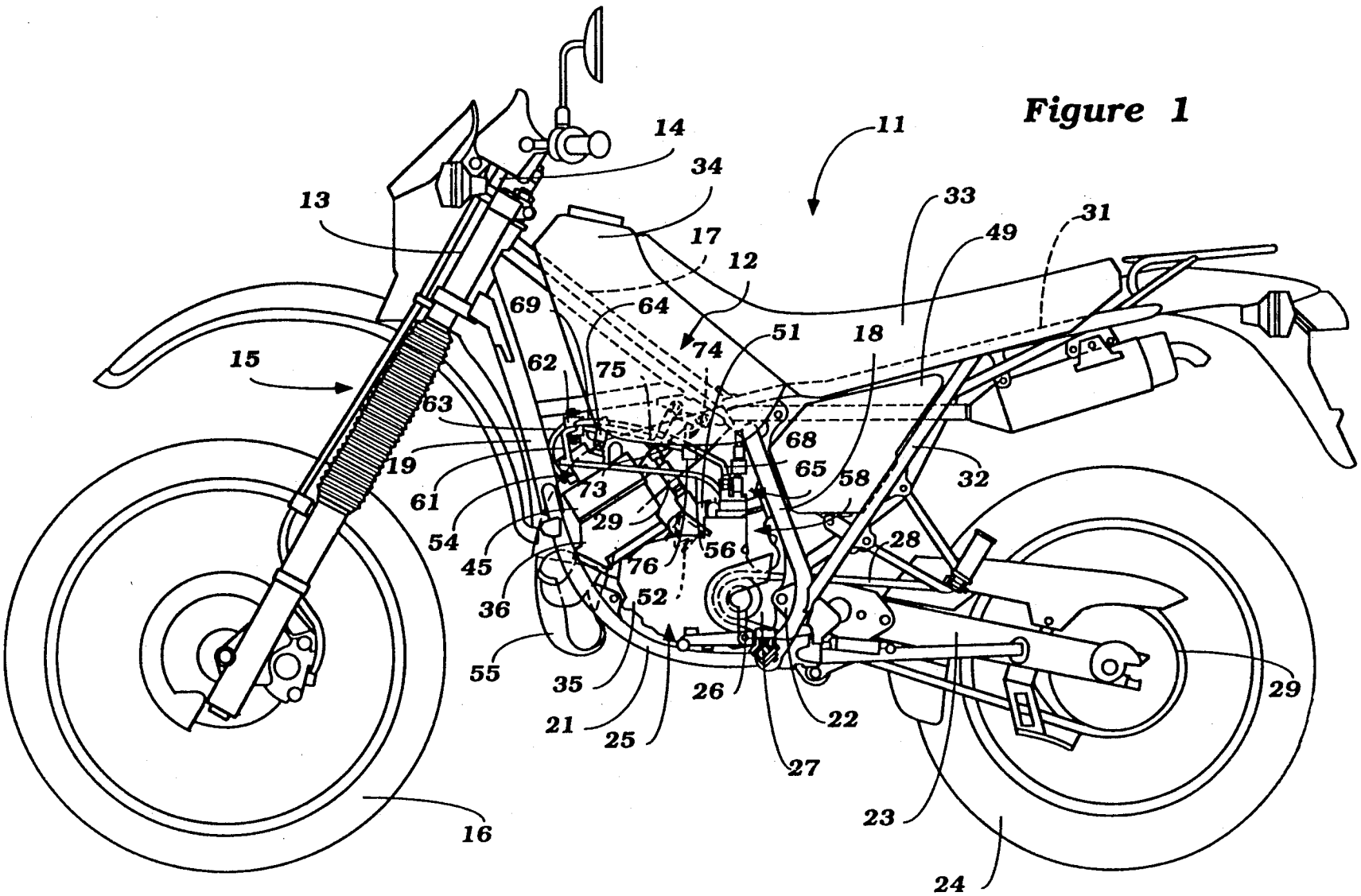
FIG. 1 is a side elevational view of a motorcycle powered by an internal combustion engine having a fuel injection system constructed in accordance with an embodiment of the invention.

Referring now in detail to the drawings and initially primarily to FIG. 1, a motorcycle constructed in accordance with an embodiment of the invention is identified generally by the reference numeral 11. The invention is described in conjunction with a motorcycle 11 because the invention, although it relates to a fuel injection system for an internal combustion engine, has particular utility in conjunction with vehicles powered by internal combustion engines such as motorcycles. Also, in the illustrated embodiment, the invention is depicted in conjunction with a two-cycle crankcase compression internal combustion engine, although it has other utility, and such engines are normally utilized for the power plants in motorcycles. The invention also has particular advantage in providing a very compact pump drive arrangement for an injection system and compactness is of extreme importance in connection with compact vehicles such as motorcycles. However, and as will be readily apparent to those skilled in the art, the invention has utility in conjunction other applications for internal combustion engines and in engines of other types than two-cycle crankcase compression engines.

The motorcycle 11 is comprised of a frame assembly 12 which is of the welded-up type and which includes a head pipe 13 which journals a front fork 14 for steering movement about a generally vertically extending axis. The front fork 14 includes a suspension system 15 and journals a wheel 16 for rotation at its lower end in a well known manner.

A main frame member 17 extends rearwardly and downwardly from the head pipe 13 and is connected at its rearward end to a further frame member 18. A down tube 19 extends downwardly from the forward lower portion of the head pipe 13 and merges into a lower tube 21 which is connected to the tube 18 at its rear end and toward the rear of the motorcycle. A suspension bracket 22 is affixed thereto and journals a trailing arm 23 for pivotal movement which is controlled by a suspension element (not shown) of a known type. A rear wheel 24 is journaled for rotation at the rear end of the trailing arm 23 in an appropriate and well known manner.

A power plant, indicated generally by the reference numeral 25, is mounted within the frame assembly 12 in an appropriate manner and includes a change speed transmission which drives an output shaft 26 to which a sprocket 27 is affixed. The sprocket 27 drives a chain 28 which, in turn, drives a sprocket 29 affixed to the rear wheel assembly 24 for driving the rear wheel in a well known manner.

The frame assembly 12 further includes a seat rail 31 which extends rearwardly from the lower rear end of the main frame member 17 and which is supported toward its rear end by a seat pillar 32 which is affixed to the frame member 18 adjacent the rear wheel suspension support 22. A seat 33 is supported upon this seat rail 31 and accommodates a rider, as is well known in this art.

A fuel tank 34 is supported by the frame assembly 12 forwardly of the seat 33 and supplies fuel, in a manner which will be described, to the power plant 25.

Referring now in detail to the remaining figures in addition to FIG. 1, the power unit 25 is comprised of a crankcase transmission assembly 35 which, as is typical with motorcycle practice, contains a change speed transmission, to be described, and a crankcase for an internal combustion engine which includes a cylinder block 36. The cylinder block 36 is affixed to the crankcase transmission assembly 35 in a known manner and which has a generally forwardly inclined cylinder bore 37 in which a piston 38 is supported for reciprocation. In the illustrated embodiment, the cylinder block 36 defines only a single cylinder bore, but it will be readily apparent to those skilled in the art how the invention can be practiced in conjunction with multiple cylinder engines.

A connecting rod 39 is pivotally connected at its upper end to the piston 38 by means of a piston pin 41 and is journaled at its lower end on a throw 42 of a crankshaft 43 which is journaled for rotation in the crankcase assembly 35 in a well known manner and which rotates about an axis that is disposed transversely to the longitudinal center line of the motorcycle 11.

A cylinder head assembly 45 is affixed to the cylinder block 36 in a known manner and defines a recess 46 which cooperates with the cylinder bore 37 and piston 38 to form the combustion chamber of the engine. A pair of spark plugs 47 are supported in the cylinder head 45 and are fired by an appropriate ignition system for initiating the combustion in the combustion chamber 46.

The engine of the power unit 25 operates on a two-stroke crankcase compression principle and for that reason the crankcase member 35 provides a sealed chamber 48 in which the crankshaft 43 rotates. An air charge is delivered to this sealed chamber through an induction system which includes an air inlet device 49 positioned rearwardly of the power unit 25 in the frame assembly 12. This air inlet device 49 delivers air to a throttle body assembly 51 that communicates with the crankcase chamber 48 through an intake passage in which a reed type check valve 52 is provided. The reed type check valve 52 insures that the charge drawn into the crankcase chamber 48 during the upward movement of the piston 39 will be compressed during its downward movement and will not flow back through the induction system as thus far described.

The charge which is compressed during the downward movement of the piston 38 is then transferred to the combustion chamber 46 through a plurality of scavenge passages 53 formed in the crankcase member 35 and cylinder block 36. A fuel and air charge is also delivered to the combustion chamber 46 by means of a fuel/air injector assembly, indicated generally by the reference numeral 54 and supported in the cylinder head 45 in appropriate manner. The construction of the fuel/air injector 54 may be of any known type. As illustrated, however, it has an injection valve that reciprocates along an axis indicated by the line L1 which is offset from the cylinder bore axis L2 forwardly of the motorcycle 11, but which is generally parallel to it. The fuel/air injector has a chamber or chambers to which air under pressure and fuel under pressure are supplied, in a manner to be described, and which is introduced into the combustion chamber 46 when the injector valve is opened.

The charge which has been burned in the combustion chamber 46 will be exhausted through an exhaust port (not shown) and delivered to an exhaust system 55 which includes silencing devices and which discharges the exhaust gases generally rearwardly and to one side of the motorcycle 11.

As is well known, two-cycle engines normally have the fuel/air charge delivered to the crankcase chamber 48 and hence the fuel will provide some cooling for the piston 38, particularly under high speed operation. However, in conjunction with this invention and since the fuel injector 54 injects directly into the cylinder 46, there might not be adequate cooling for the piston 38 under some conditions. Therefore, there is provided an auxiliary fuel injector 56, which may be either a pure fuel injector or a fuel/air injector and which injects fuel into the throttle body 51 upstream and adjacent the reed type check valve 52 under selected running conditions.

The fuel/air injector 54 is provided with an air manifold 57 which receives air from an air compressor, indicated generally by the reference numeral 58, and which is driven by the power unit 25 in a manner to be described. This compressed air is delivered through a delivery conduit 59 which communicates with the manifold 57 and which has a line 61 which goes to a pressure regulator 62 for regulating the air pressure to the desired value. This is done by dumping excess air to the atmosphere through an atmospheric return 63.

In addition, fuel is supplied to a fuel injector 64 of the fuel/air injector 54 from a fuel pump 65 which is also driven in a manner which will be described. The fuel pump 65 draws fuel from the fuel tank 34 through a delivery conduit 66 in which a filter 67 is positioned. This fuel is delivered to a high pressure line 68 which also communicates with the regulator through a delivery conduit 69. The regulator 62, in addition to regulating air pressure, regulates the fuel pressure delivered to the injector 64. This is done by bypassing fuel back through a return line 71 to the fuel tank 15. The return line 71 supplies the manifold fuel injector 56 and a line 72 goes to a further low pressure fuel regulator 73 that regulates the fuel pressure delivered to the injector 56 to be lower than the pressure delivered to the fuel injector 64. This regulator 73 returns fuel to the tank 34 through a return conduit 74.

Figure 2:
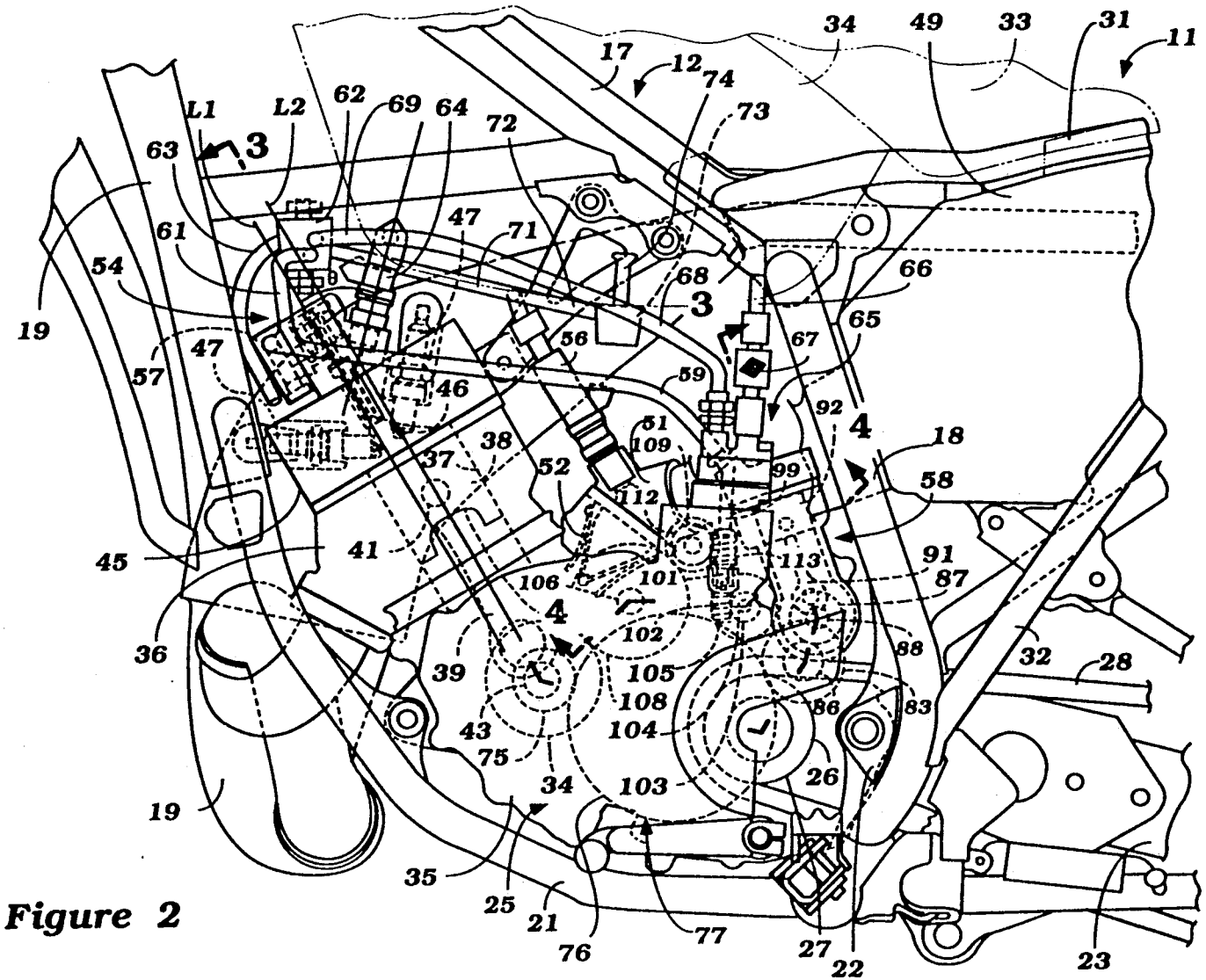
FIG. 2 is an enlarged side elevational view of the motorcycle showing the engine.

The drive for the air compressor 58 and fuel pressure pump 65 will now be described by particular reference to FIGS. 2–4. This drive also includes the drive for the sprocket 27 and, accordingly, this portion of the transmission will also be described.

Figure 3:
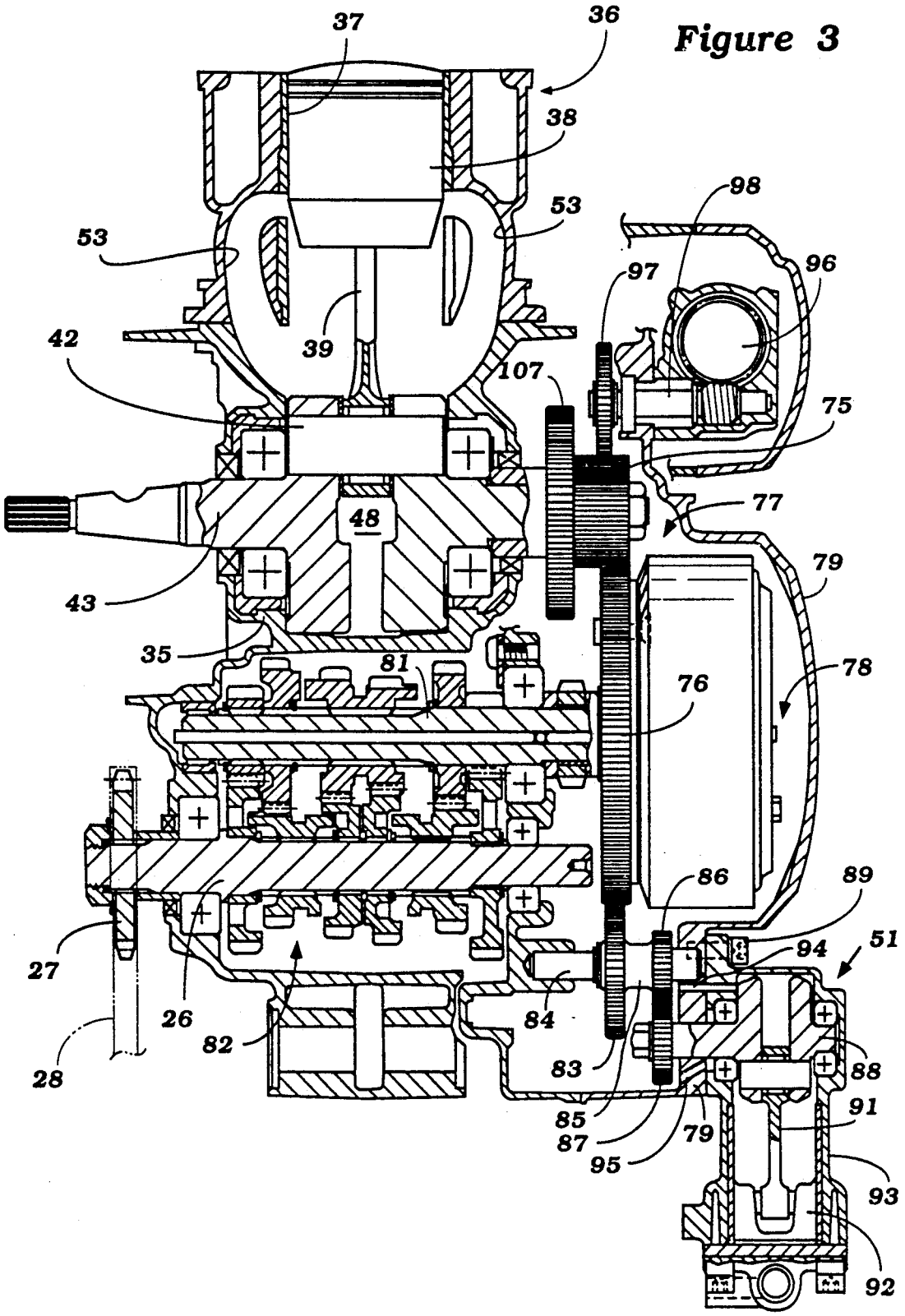
FIG. 3 is a cross-sectional view taken along the line 3—3 of FIG. 2.
Figure 4:
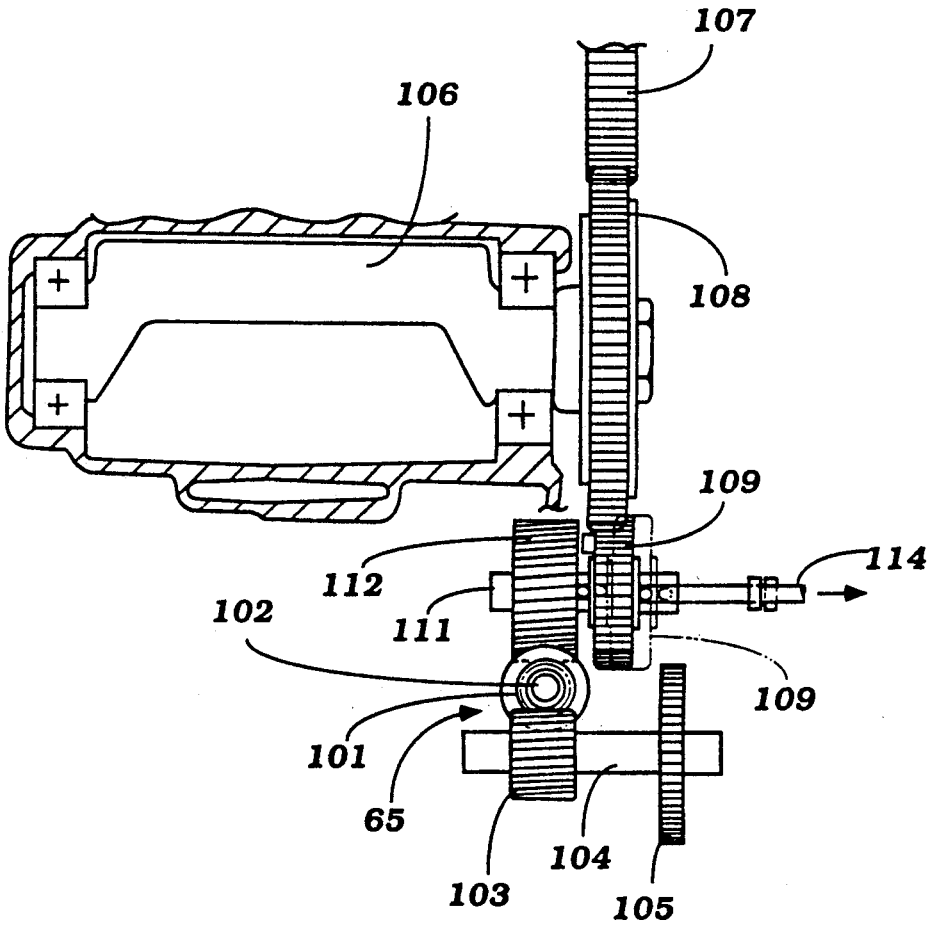
FIG. 4 is a cross-sectional view taken along the line 4—4 of FIG. 2 and shows the drive for the fuel pump and a balancer shaft for the engine.

It will be noted from FIG. 3 that the crankshaft 43 has an extending end on one side of the engine and specifically crankcase 35 to which a drive gear 75 is affixed. The gear 75 meshes with a gear 76 which forms the input to a clutch assembly 77. The clutch assembly 77 is contained within a clutch housing 78 formed at this side of the engine and enclosed by a cover plate 79. The driven disc of the clutch assembly 77 is adapted to be coupled to a primary shaft 81 of a change speed transmission, indicated generally by the reference numeral 82.

This change speed transmission includes a plurality of pairs of intermeshing gears on the primary shaft 81 and the output or secondary shaft 26 which is also journaled within the crankcase assembly 35. The primary and secondary shafts 81 and 26 rotate about axes that are parallel to the rotational axis of the crankshaft 43 and, as aforenoted, are transversely extending to the longitudinal center line of the motorcycle 11. The intermeshing gear sets of the change speed transmission 82 are selected in an appropriate manner to vary the speed ratios between the primary shaft 81 and the secondary or output shaft 26. As has been previously noted, the drive sprocket 27 is connected to the outer end of the secondary or output shaft 26 for driving the rear wheel 24 at the selected speed ratios.

The clutch drive gear 76 also is enmeshed with a gear 83 formed on a compressor drive shaft 84 that is journaled within the crankcase 35 and the cover assembly 79. This shaft 84 has an integral hub portion 85 to which a second gear 86 is affixed. The gear 86 is enmeshed with a gear 87 formed at one end of a crankshaft 88 of the air compressor 51. The air compressor 51 is mounted on the cover plate 79 by means of a plurality of threaded fasteners 89. The crankshaft 88 is connected by means of a connecting rod 91 to a piston 92 that reciprocates within a cylinder block 93 of the air compressor 51. Suitable inlet and exhaust valves permit air to be drawn into the compressor 51 and discharged through the conduit 59 afore described.

Passages 94 and 95 may be formed in the end wall 79 and cylinder block 93 of the air compressor 51 for its lubrication from the lubricant contained within the crankcase transmission assembly of the power unit 25.

The power unit 25 is provided with a lubricating system in addition to the crankcase chamber and this includes a lubricant pump 96 (FIG. 3) that is driven from the crankshaft drive gear 75 through a gear 97 affixed to a pump drive shaft 98. The lubricant system for the engine may be of any known type.

The drive for the fuel pump 65 will now be described by particular reference to FIGS. 2 and 4. The fuel pump 65 is of the gerotor type and because it has a conventional construction it is not illustrated in any detail. However, the pump 65 has an input shaft 99 which rotates about a generally vertically extending axis. The shaft 99 is coupled through a one-way clutch 101 to a worm gear 102 which is, in turn, driven by a worm wheel 103 fixed to a drive shaft 104. The shaft 104 carries a drive gear 105 which is enmeshed with the clutch drive gear 76 for driving the fuel pump 65 at an appropriate speed ratio relative to the crankshaft speed during normal engine running. As has been previously noted, however, this speed may be too low to provide adequate fuel pressure during cranking of the engine. For this purpose, there is provided a further drive for the fuel pump 65 which is operative during starting and which will drive the fuel pump 65 at a higher speed ratio relative to the rotational speed of the crankshaft 43. This drive is taken from a drive for a balancer shaft 106 that is journaled for rotation about an axis parallel to the axis of rotation of the crankshaft 43 and which is driven from the crankshaft 43 by a gear 107 which is affixed to the crankshaft adjacent the gear 75 (FIG. 3). The gear 107 is enmeshed with a gear 108 fixed to the balancer shaft 106.

A further drive gear 109 is slidably supported for engagement with the gear 108 on a pump drive shaft 111. A worm wheel 112 is affixed to this shaft 111 and is engaged with a further worm gear 113 that is connected directly to the drive shaft 99. When the gear 109 is moved into meshing engagement with the gear 108, the pump drive shaft 99 will be driven at a faster speed ratio relative to the crankshaft 43 than previously and the overrunning clutch 101 will permit this drive relationship without difficulty. An actuator shaft 114 is connected to the gear 109 for moving it between it engaged and its disengaged positions. The actuator 114 may be operated either manually by the operator, by the operation of the starter of the engine or by a servo motor that is responsive to actual engine speed.

It should be readily apparent from the foregoing description that the described construction provides a very effective fuel pump drive for a fuel injection system of an internal combustion engine and in which the fuel pump can be driven at a higher speed ratio during cranking and starting so as to insure adequate fuel pressure to the fuel injectors of the engine under all running conditions including starting. Also, it should be noted that the pump drive is very compact in that both the fuel pump 65 and air compressor 58 are positioned substantially inwardly of the outer surface of the clutch cover 79 so as to provide a very compact assembly. Of course, the foregoing description is that of a preferred embodiment of the invention and various changes and modifications may be made without departing from the spirit and scope of the invention, as defined by the appended claims.

We claim:

1. A fuel injection system for an internal combustion engine comprising starter means for starting said engine, a fuel/air injector, a fuel pump for supplying fuel under pressure to said fuel/air injector, an air pump for supplying air to said fuel/air injector, and drive means for driving said fuel pump and said air pump from said engine, said drive means for driving one of said pumps from said engine being effective for driving said pump at a first high speed ratio during operation of said starter means and at a different lower speed ratio during running of said engine and when said starter means is not being driven, said drive means for the other of said pumps driving said other pump at a constant speed ratio.

2. A fuel injection system for an internal combustion engine as recited in claim 1 wherein one of the speed ratios provides a substantially higher rate of speed of the fuel pump in relation to the engine speed than the other speed ratio.

3. A fuel injection system for an internal combustion engine as recited in claim 1 further including means for shifting the drive means between the speed ratios.

4. A fuel injection system for an internal combustion engine as recited in claim 1 wherein the pump driven at different speed ratios comprises the fuel pump.

5. A fuel injection system for an internal combustion engine as recited in claim 4 wherein one of the speed ratios provides a substantially higher rate of speed of the fuel pump in relation to the engine speed than the other speed ratio.

6. A fuel injection system for an internal combustion engine as recited in claim 5 further including means for shifting the drive means between the speed ratios.

7. A fuel injection system for an internal combustion engine as set forth in claim 2 wherein there are further provided regulators means for regulating the pressure of fuel supplied to the fuel/air injector by the fuel pump in relation to the pressure of air supplied to the fuel/air injector by the air pump.

8. A fuel injection system for an internal combustion engine as set forth in claim 5 wherein there are further provided regulators means for regulating the pressure of fuel supplied to the fuel/air injector by the fuel pump in relation to the pressure of air supplied to the fuel/air injector by the air pump.

* * * * *